US011623668B2

(12) United States Patent
Morin

(10) Patent No.: US 11,623,668 B2
(45) Date of Patent: Apr. 11, 2023

(54) METHODS AND SYSTEMS FOR A VEHICLE TRUCK YAW SEPARATOR

(71) Applicant: Transportation IP Holdings, LLC, Norwalk, CT (US)

(72) Inventor: Andrew J. Morin, Mokena, IL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 511 days.

(21) Appl. No.: 16/803,753

(22) Filed: Feb. 27, 2020

(65) Prior Publication Data

US 2020/0290655 A1 Sep. 17, 2020

Related U.S. Application Data

(60) Provisional application No. 62/818,195, filed on Mar. 14, 2019.

(51) Int. Cl.
*B61F 5/40* (2006.01)
*B61F 5/14* (2006.01)

(52) U.S. Cl.
CPC ..... *B61F 5/40* (2013.01); *B61F 5/142* (2013.01)

(58) Field of Classification Search
CPC ..... B61F 5/38; B61F 5/40; B61F 5/142
See application file for complete search history.

(56) References Cited

U.S. PATENT DOCUMENTS 4,300,454 A * 11/1981 Scheffel ..... B61F 5/40 105/182.1
5,647,283 A * 7/1997 McKisic ..... B61F 5/38 105/167

FOREIGN PATENT DOCUMENTS

EP 2886412 A1 6/2015

* cited by examiner

*Primary Examiner* — Robert J McCarry, Jr.
(74) *Attorney, Agent, or Firm* — McCoy Russell LLP

(57) ABSTRACT

A vehicle truck includes a first side frame, a second side frame, a bolster, a first yaw separator connected to the first side frame, and a second yaw separator connected to the second side frame. Each yaw separator includes two steering arms and an arm connector assembly. The yaw separators are configured to alter yaw movement of the truck that leads to truck hunting.

20 Claims, 11 Drawing Sheets

METHODS AND SYSTEMS FOR A VEHICLE TRUCK YAW SEPARATOR

CROSS REFERENCE TO RELATED APPLICATIONS

The present application claims priority to U.S. Provisional Patent Application No. 62/818,195, filed on Mar. 14, 2019. The entire contents of the above-listed application are incorporated herein by reference for all purposes.

FIELD

Embodiments of the subject matter disclosed herein relate to trucks and bogies for rail vehicles or other vehicles.

BACKGROUND

A truck (also known as a bogie) is a chassis or framework that carries a wheel set of a vehicle, e.g., a railcar or other rail vehicle. Truck hunting in rail vehicles is an unstable lateral oscillating movement of the wheel set or the truck to which wheel axles of the wheel set are attached. The wheel set or truck continuously oscillates from one rail to the other rail while the rail vehicle traverses a track. Hunting occurs when the wheel set of the truck shifts toward one rail causing a rolling radius difference. The wheel set then "hunts" for rolling radius equilibrium by oscillating back and forth from side to side. Truck hunting tends to increase wheel wear and damage, fuel consumption, the need for railroad track or rail repair, and decreases high speed stability (HSS) for both empty and loaded rail vehicles. In certain instances, truck hunting has also led to derailment, damage to cargo, and damage to rail vehicles.

At higher speeds, even minor imperfections or perturbations in the tracks, rails, or in equipment can lead to truck hunting. Curved railroad tracks or rails pose a different set of challenges for the trucks. When the truck encounters a curve or turn, the distance traversed by the wheels on the outside of the curve is greater than the distance traversed by wheels on the inside of the curve, resulting in lateral and longitudinal forces between the respective wheels and the tracks or rails. These wheel forces often cause the wheel set to turn in a direction opposing the curve or turn. On trucks with insufficient rigidity, this can result in a condition variously known as warping, wherein the side frames remain parallel, but one side frame moves forward with respect to the other side frame.

Another known issue relates to various trucks that have side frames with flat rectangular surfaces against which friction wedges are pressed to produce frictional damping to control vertical bounces and other oscillatory modes. Normally, significant clearance exists between the side frame's column face and nearby surfaces of a bolster to enable assembly and proper relative motion during use. This clearance is undesirable in that it enables the truck to become warped or change shape from the intended parallel and perpendicular arrangement. Such warping alone or in combination with truck hunting tends to increase wear on the tracks, rails, truck components, and/or equipment as well as rolling resistance which increases vehicle fuel consumption and engine pollution emissions, and decreases vehicle efficiency.

Various truck assemblies have been proposed to address these problems, however, these assemblies also have issues. For example, the truck assembly proposed in U.S. Pat. No. 5,647,383 includes steering arms attached to bearing adapters. The steering arms have overlapping end portions that define elongated apertures through which a pin is inserted to connect the steering arms. This arrangement enables the arms to slide relative to each other, allowing the wheel set axles to develop an inter-axle yaw angle while physically inhibiting inter-axle shearing movements. This assembly allows out of phase yaw movement with respect to the two axles, and provides a physical restriction against in-phase yaw movement. However, because of this arrangement, large forces may act on components of the truck assembly which may increase breakage or degradation of the components. The truck assembly proposed in European Patent 2,886,412 includes elastic elements connecting wheel sets of a truck. The elastic elements prevent in-phase yaw movement of the wheel sets by physically restricting movement of the wheel sets. These arbitrarily stiff primary and secondary suspensions may prevent truck hunting, however, performance of these suspensions may be limited on curves.

It may be desirable to provide a yaw separator, and a truck incorporating a yaw separator, that differ from existing trucks and truck components.

BRIEF DESCRIPTION

Embodiments are disclosed for a vehicle truck wherein the truck includes two yaw separators that reduce (e.g., inhibit and/or minimize) truck hunting, warping, and related issues. In one embodiment, a truck includes a first side frame, a second side frame, a bolster, a first yaw separator connected to the first side frame, and a second yaw separator connected to the second side frame. The first yaw separator includes a first steering arm, a second steering arm, and an arm connector assembly connected to the first steering arm and the second steering arm. The second yaw separator includes a third steering arm, a fourth steering arm, and a second arm connector assembly connected to the third steering arm and the fourth steering arm.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present disclosure will be better understood from reading the following description of non-limiting embodiments, with reference to the attached drawings where like reference numerals refer to like parts, wherein below.

DETAILED DESCRIPTION

By incorporating yaw separators of the present disclosure into side frames of a rail vehicle truck, only the dynamics that lead to truck hunting may be altered while the properties and effects of three-piece railroad truck suspensions may be retained. For example, a first yaw separator may elastically collect energy from yaw action at a first pedestal jaw of a first side frame and instantaneously transmit that energy to a second pedestal jaw within the first side frame, such that any in phase cooperation of the wheelsets, which may be coupled to bearing adapter assemblies, to induce warp is opposed. The yaw separator may continually encourage yaw displacements to remain out of phase. For example, as yaw displacement away from a neutral position (e.g., a straight line) of one bearing adapter assembly within its respective pedestal jaw begins to occur, the displacement may store some energy in the elastic structure of the yaw separator. In this way, the separator may undergo elastic movement due to flexing and bending. Thus, the yaw separator described herein may have a subtle, yet effective, impact on the dynamics of the railcar suspension system without rigidly enforcing any major changes to the degrees of freedom of the truck. This subtle impact may enable higher speeds with reduced wear on all components of the rail vehicle system and potentially to adjacent rail vehicles.

Figure 1:
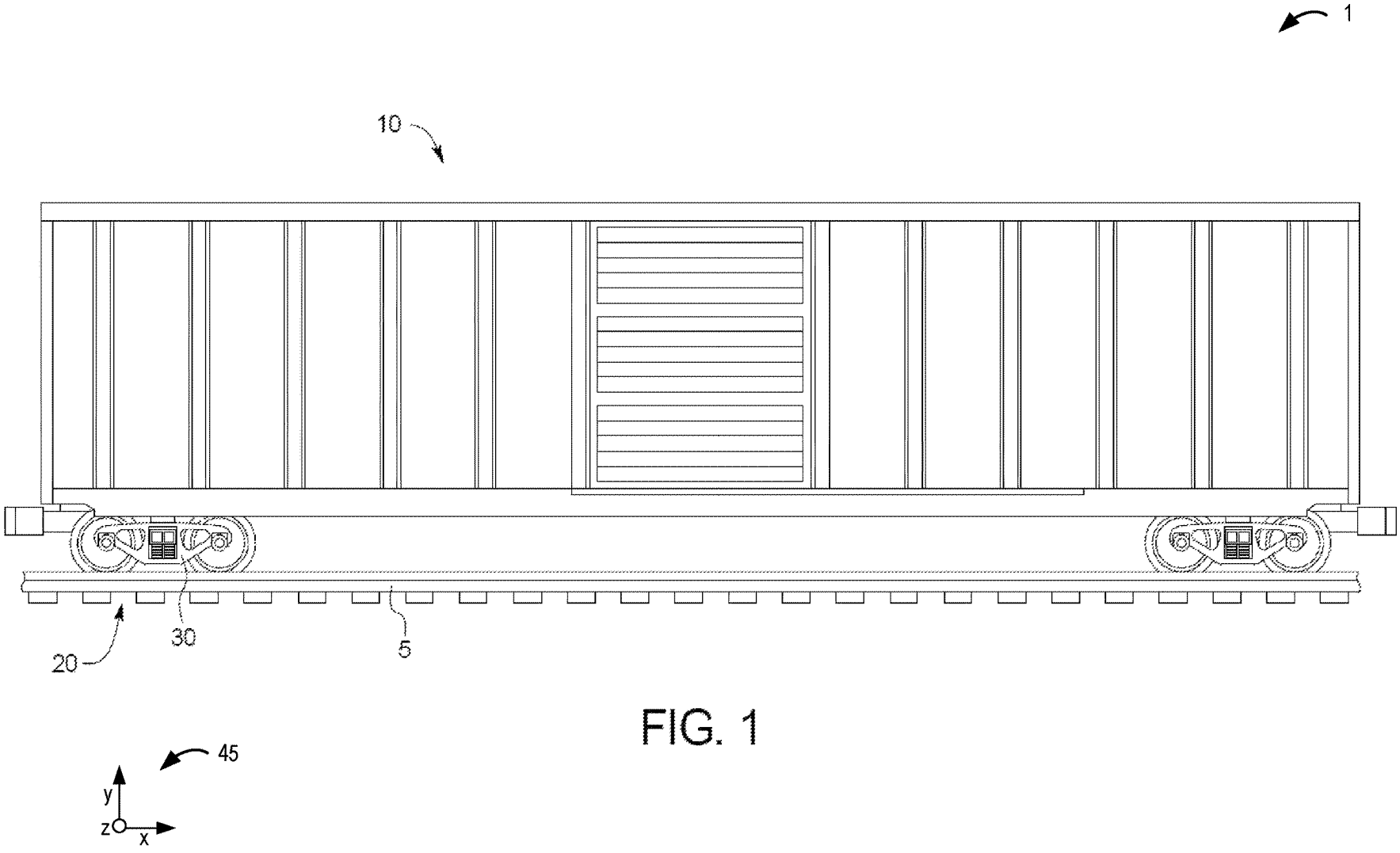
FIG. 1 is a side view of a freight rail vehicle positioned on railroad tracks.
Figure 2:
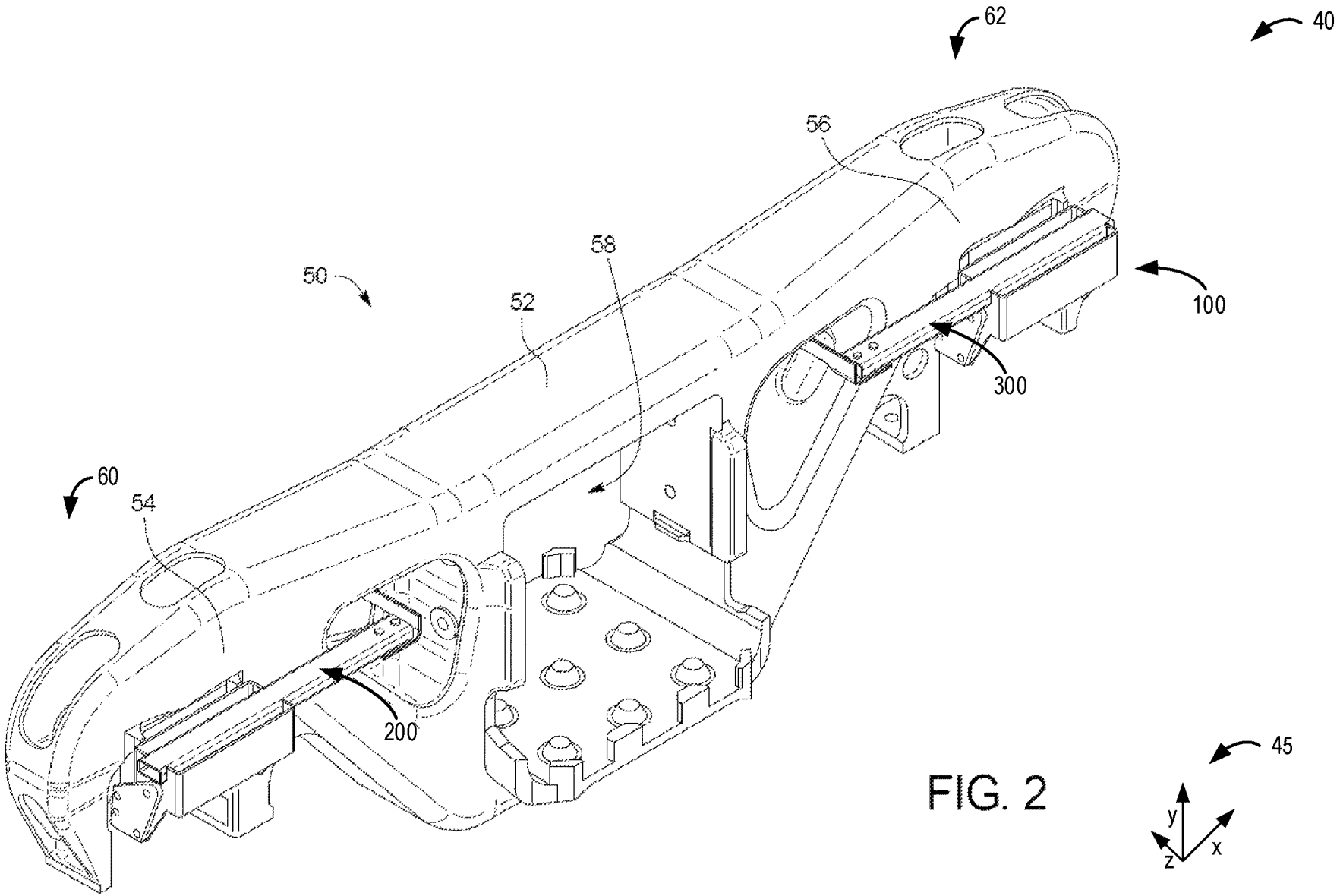
FIG. 2 is a side perspective view of an example side frame of a vehicle truck, with the side frame connected to a yaw separator of one embodiment of the present disclosure.
Figure 3:
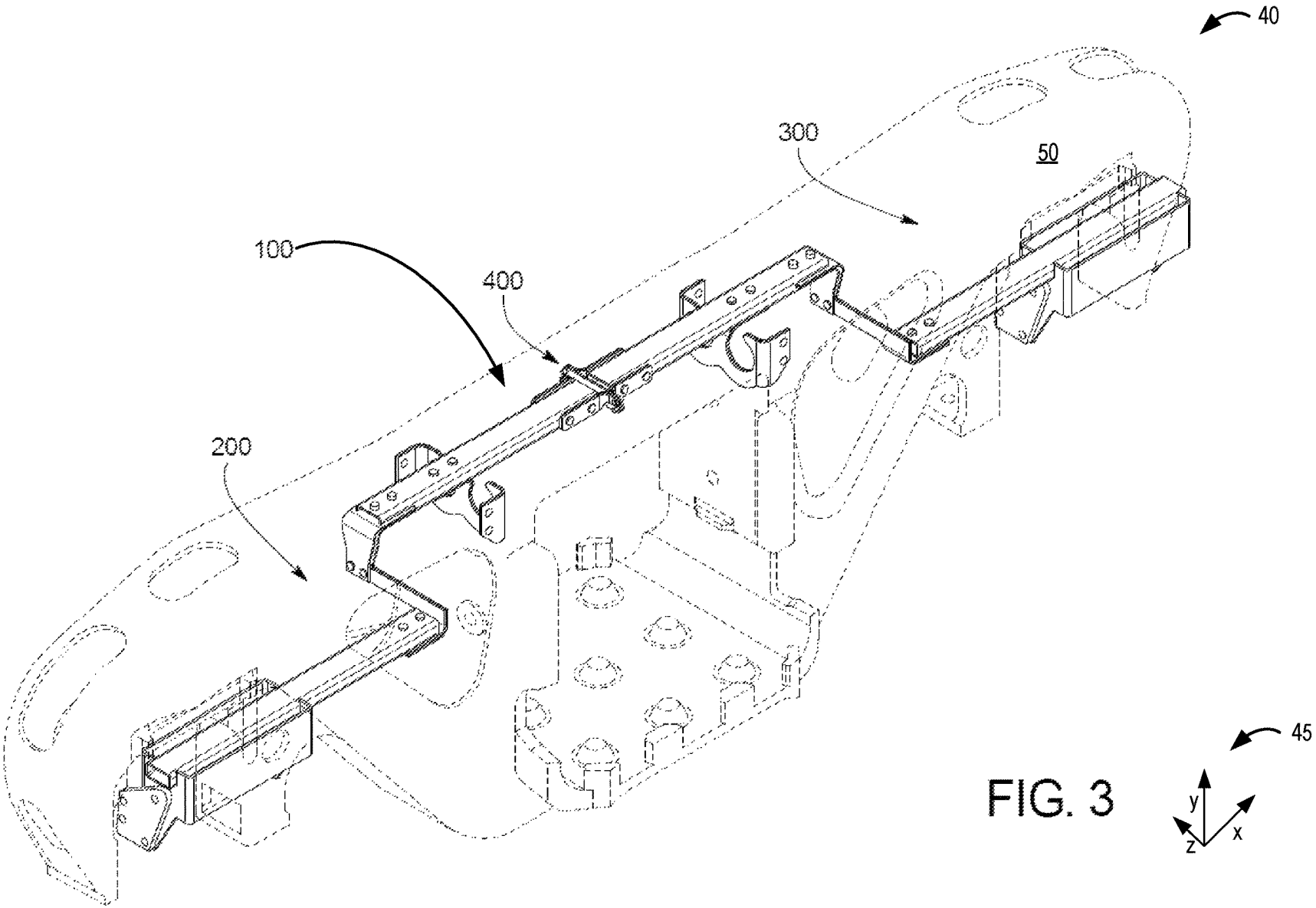
FIG. 3 is a side perspective view of the side frame and yaw separator of FIG. 2, wherein the side frame is shown in phantom.
Figure 8:
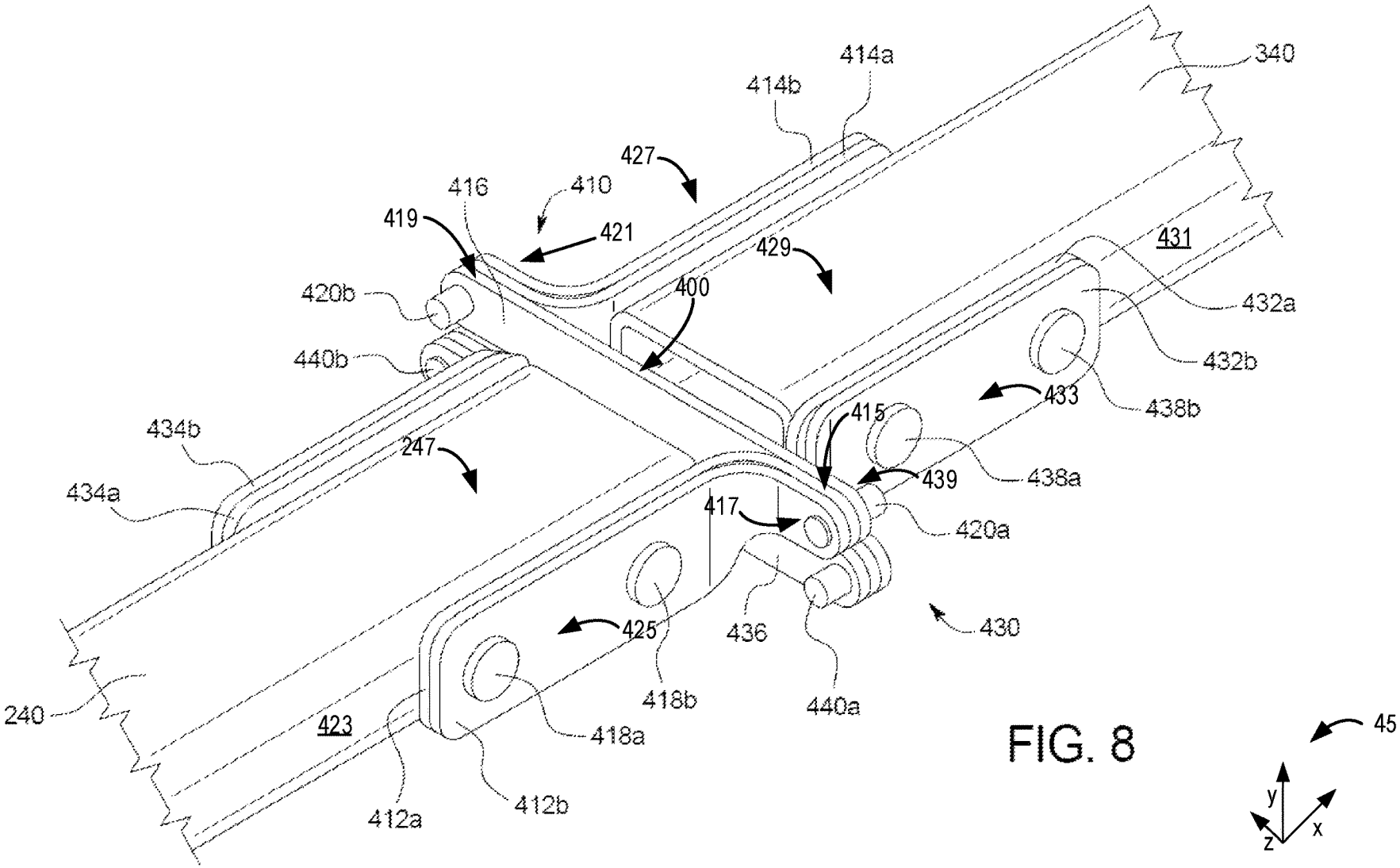
FIG. 8 is an enlarged top perspective view of the arm connector assembly of the yaw separator of FIG. 2 connected to the interior force transfer members of the yaw separator.
Figure 9:
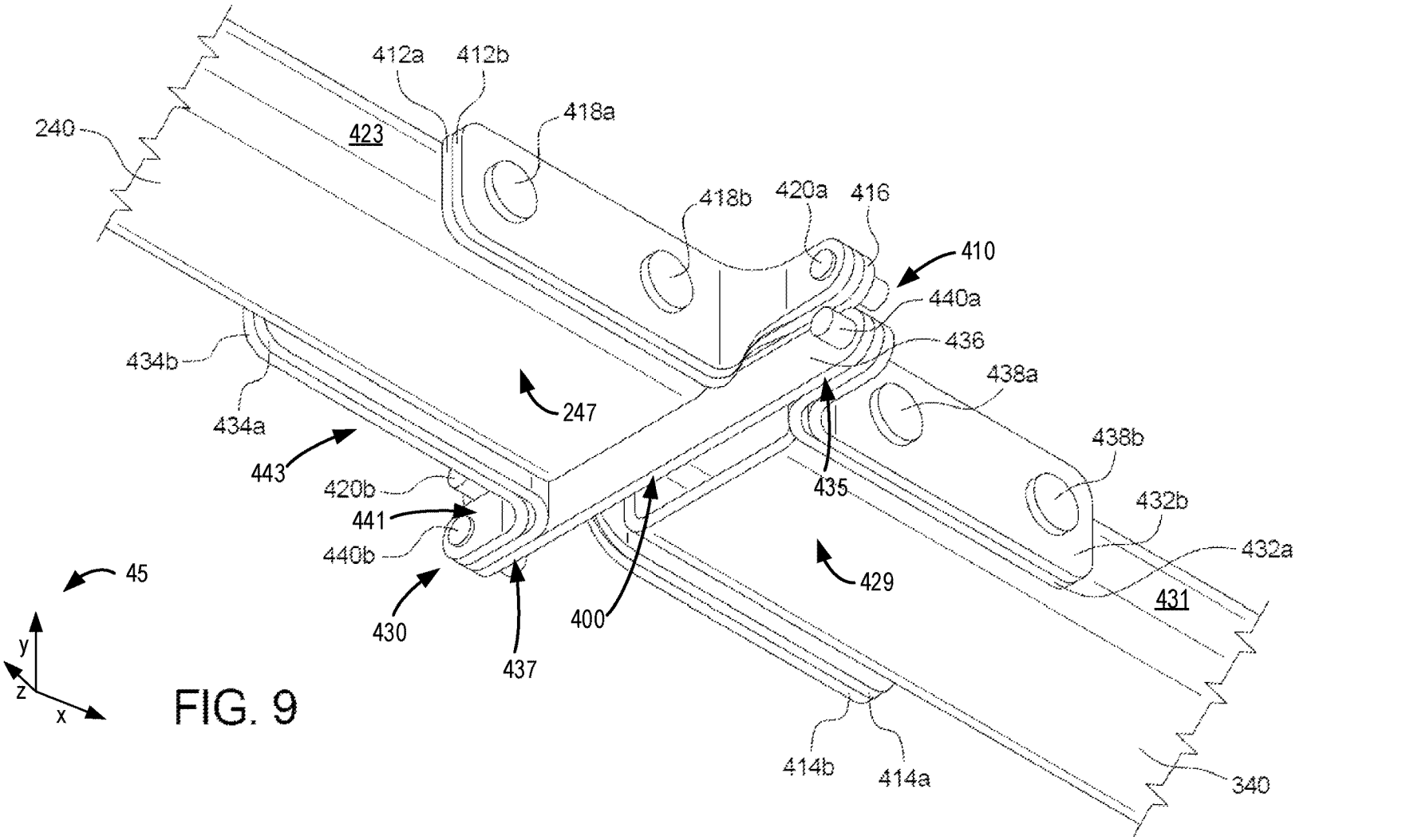
FIG. 9 is an enlarged bottom perspective view of the arm connector assembly and the interior force transfer members shown in FIG. 8.
Figure 10:
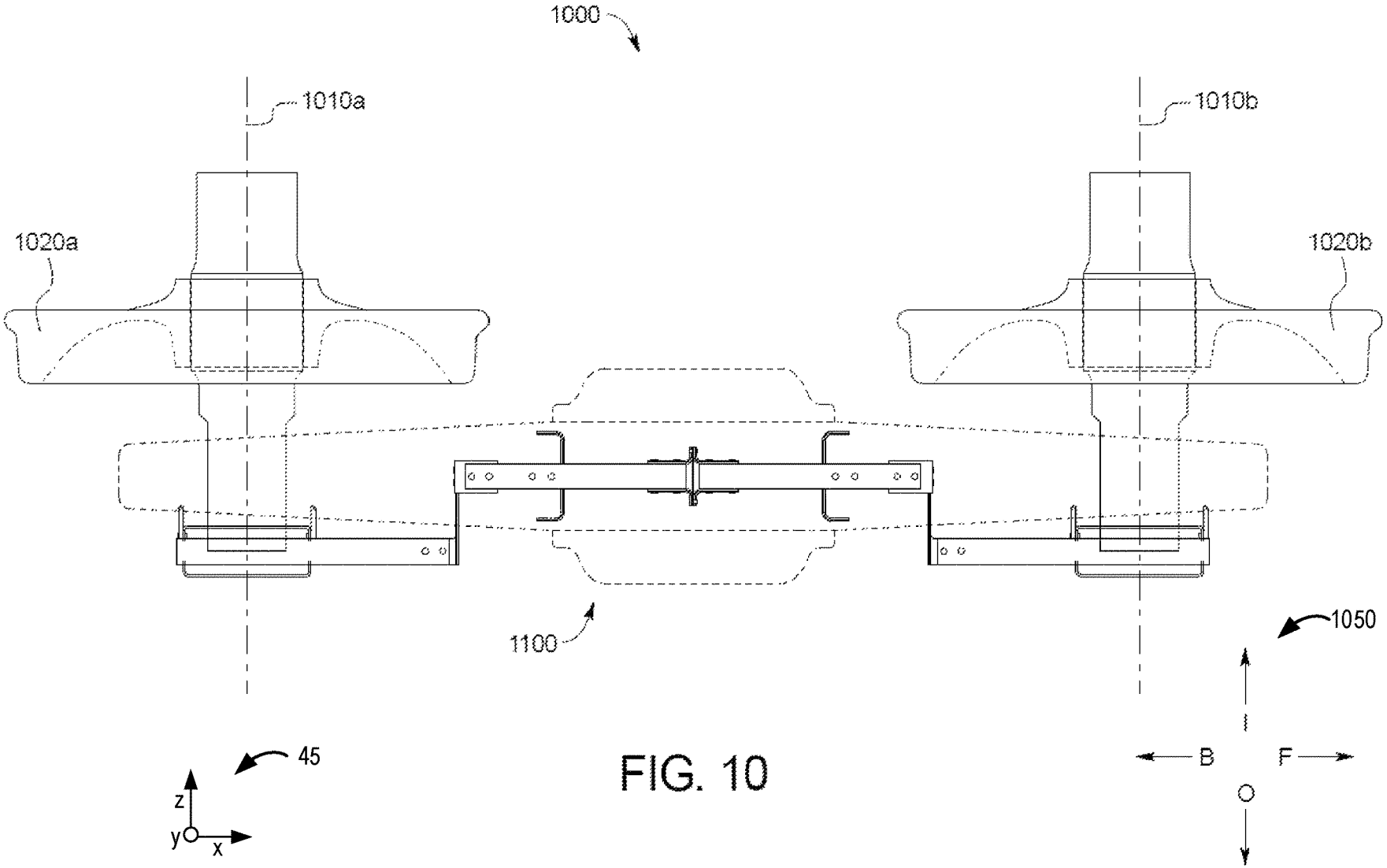
FIG. 10 is a top view of the yaw separator of FIG. 2 connected to a side frame and coupled to a pair of spaced apart parallel wheel sets.
Figure 11:
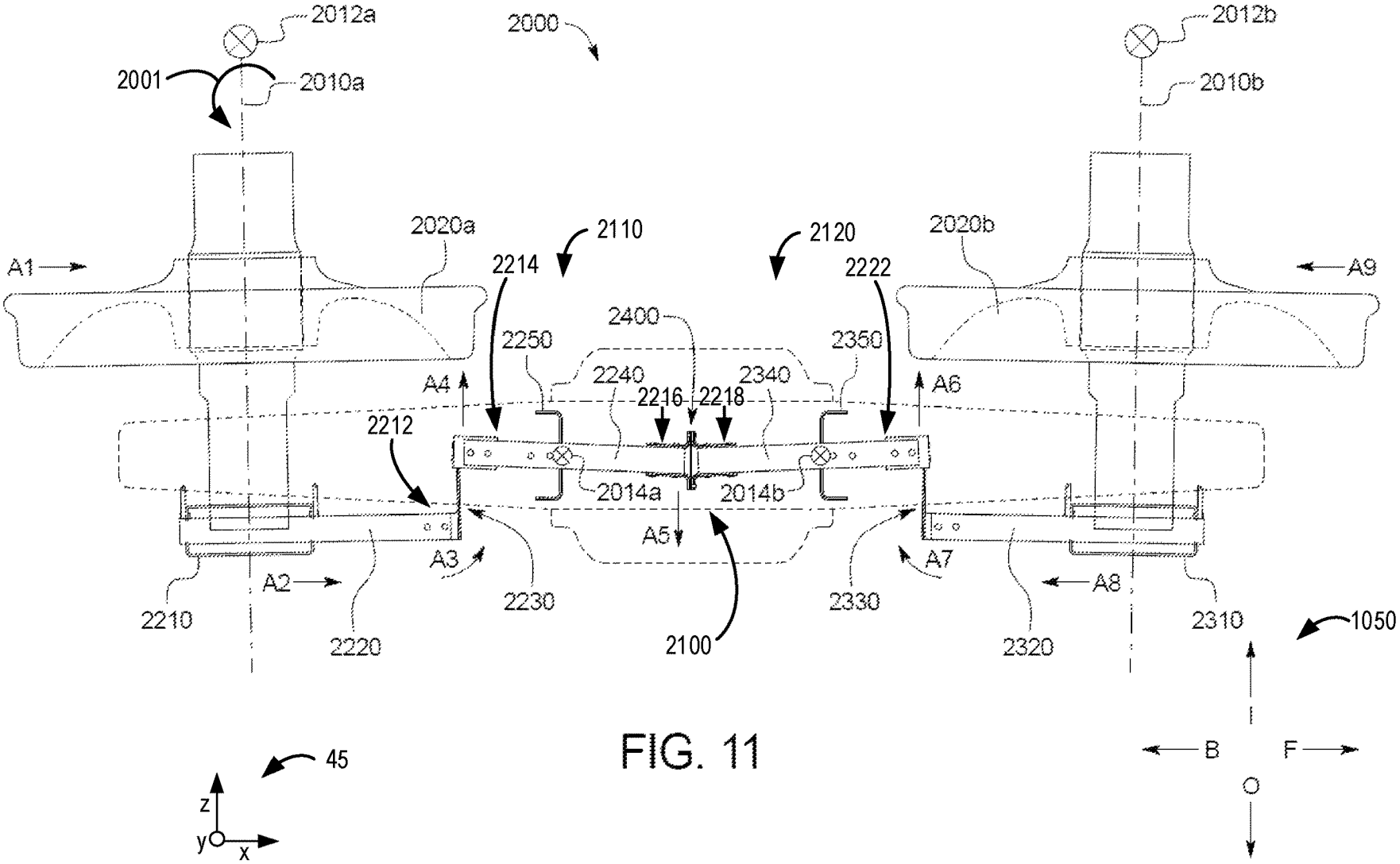
FIG. 11 is a top view of the yaw separator of FIG. 10, illustrating movement of the yaw separator when the left wheel has moved forward and the right wheel has moved backward.
Figure 12:
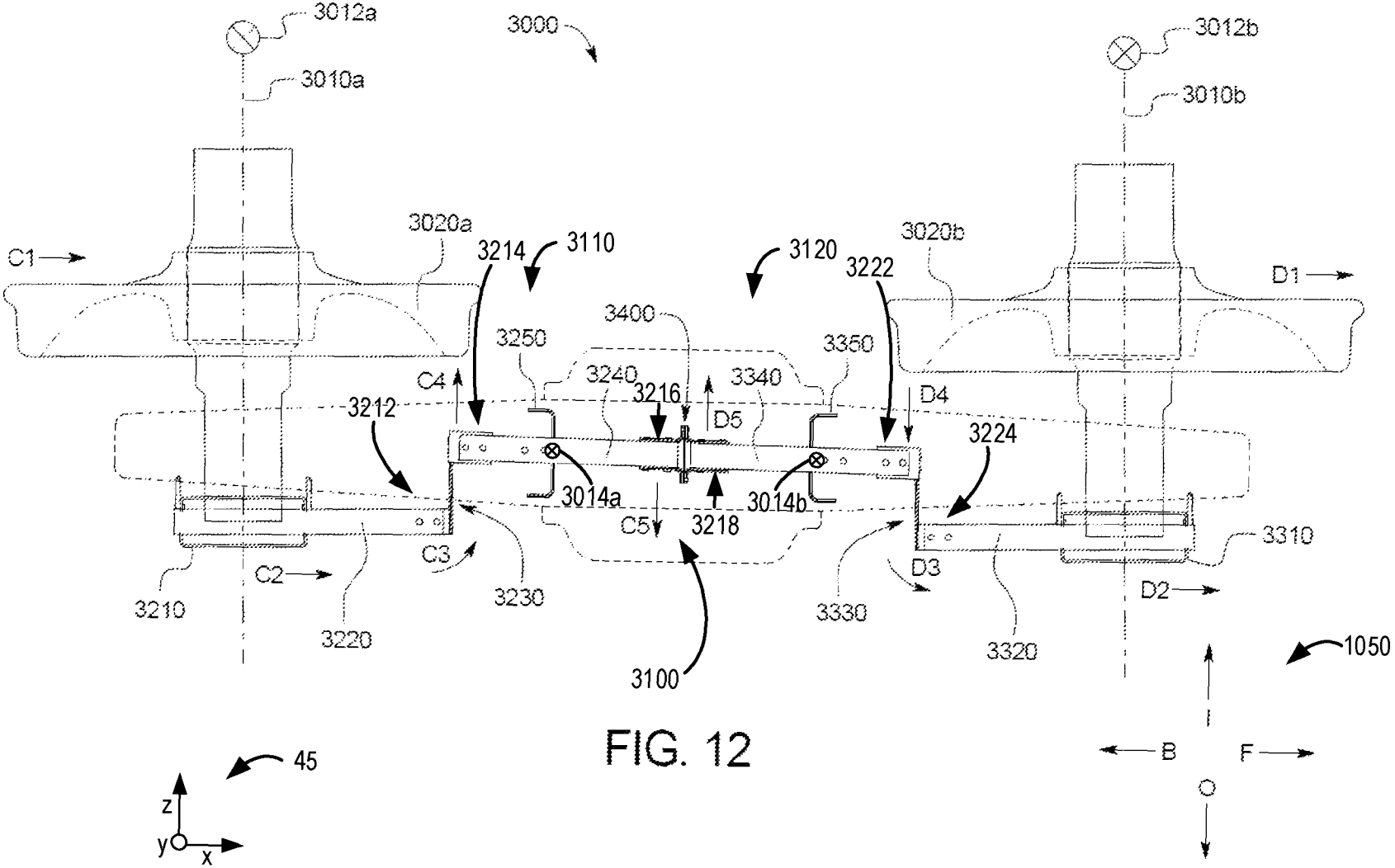
FIG. 12 is a top view of the yaw separator of FIG. 10, illustrating movement of the yaw separator when both the left and right wheel have moved forward.

FIG. 1 depicts a rail vehicle (e.g., freight car) positioned on railroad tracks. FIGS. 2 and 3 show different views of a side frame of a rail vehicle truck connected to a yaw separator according to an example embodiment of the present disclosure. FIGS. 4-7 show enlarged views of the yaw separator of FIGS. 2 and 3. FIGS. 8 and 9 show two views of an arm connector assembly of the yaw separator of FIGS. 2 and 3, wherein the arm connector assembly is connected to interior force transfer members. FIGS. 10-12 show different views of the yaw separator of FIGS. 2 and 3 connected to the side frame and coupled to a pair of spaced apart parallel wheel sets, wherein FIGS. 11 and 12 illustrate movement of the yaw separator with respect to movement of the wheel sets. A set of reference axes 45 are provided for comparison between views shown, indicating a y-axis, a z-axis, and an x-axis. In some examples, the y-axis may be parallel with a direction of gravity, with the x-axis defining the horizontal plane.

Referring now to FIG. 1, FIG. 1 is a side view 1 of a rail vehicle truck that is generally indicated by numeral 20. The truck 20 is shown with respect to a rail vehicle 10 configured to roll along railroad tracks or rails 5. The truck 20 includes a bolster, a bolster bowl on the bolster, a first side frame 30, and a second side frame (not shown). Generally, the side frames each extend longitudinally in the same direction as rails 5 that define the railroad track and the bolster is transversely mounted between the two side frames. The truck 20 also includes two axles that support the side frames, four wheels, and four roller bearing assemblies respectively mounted on the ends of the axles. When the rail vehicle 10 is in motion (e.g., rolling down the tracks or rails 5), the truck 20 may be subject to warping as previously described. Warping may occur when one side frame (e.g., the first side frame 30) moves forward with respect to the other side frame (e.g., the second side frame) and the bolster is not "square" with either of the side frames. Such warping alone or in combination with truck hunting may lead to a disruption of train operating conditions and/or the railroad infrastructure, decreased vehicle efficiency, impose undue stress on cargo, increase fuel consumption, and/or result in wheel climb derailment.

Thus, according to the embodiments disclosed herein, a vehicle truck may include two yaw separators that may mitigate truck hunting and the effects thereof. As needed (e.g., in response to truck hunting oscillations), the mechanism of the yaw separator may move or deflect compliantly so that the bearing adapter assemblies within the side frame to which the yaw separator is connected (as previously described) may move relative to one another as necessitated by track conditions where the truck behavior may not become unstable. More specifically, when the truck starts to hunt or warp, each of the yaw separators may apply an opposing biasing force to the bearing assemblies of the side frames thereby reducing in-phase yaw movement of the wheel sets and reducing or inhibiting truck hunting as well as warping.

Further, although the yaw separator of the present disclosure is not primarily intended to produce resistance against other undesired directional movements of the side frames and bolster, in various circumstances and embodiments, the yaw separator may act or co-act to permit certain directional movements and/or may act or co-act to reduce and/or inhibit other undesired directional movements alone or in combination with other components of the truck.

FIGS. 2-12 show an embodiment of a yaw separator 100 that may form part of a rail vehicle truck. The truck may include a first side frame 50, a second side frame, and a bolster. As previously described, the bolster may be transversely mounted between the two side frames and the two side frames may extend longitudinally from the bolster, where each side frame may be parallel to rails that define a railroad track. A bolster bowl may be connected to the bolster and support a body of a train car so that the body is resting on the bolster bowl and swivelly coupled to the truck. The yaw separator 100 may be connected to the first side frame 50, and a second yaw separator may be connected to the second side frame. The yaw separator 100 may include an arm connector assembly 400 located in between and fixedly connected to a first steering arm 200 and a second steering arm 300 (as further described below). Similarly, the second yaw separator of the truck may include a second arm connector assembly in between and fixedly connected to a third steering arm and a fourth steering arm. Since the yaw separator 100 and the second yaw separator are identical in various embodiments of the present disclosure, only the yaw separator 100 will be described in detail herein. It should be appreciated that in other embodiments, the yaw separator 100 and the second yaw separator may not be identical.

FIG. 2 is a side perspective view 40 of an embodiment of the first side frame 50 of the truck connected to the yaw separator 100. Since the first side frame 50 and the second side frame are identical in various embodiments of the present disclosure, only the first side frame 50 will be described herein. Within the truck, the second side frame may mirror the first side frame 50. It should be appreciated that in other embodiments, the first side frame 50 and the second side frame may not be identical. The first side frame 50 may include a longitudinally (e.g., parallel to the rails of the railroad track and the second side frame, along the x-axis) extending body 52. The body 52 may be symmetric about the y-z plane and include a generally rectangular center opening 58. The center opening 58 may accommodate and support a first end of a bolster (e.g., with a second end of the bolster supported by a central opening in the second side frame). The body 52 may be comprised of a hollow volume through which the yaw separator 100 may be incorporated into the first side frame 50, as further shown in FIG. 3. The body 52 further includes two downwardly (e.g., parallel to the y-axis) extending pedestal jaws. For example, a first pedestal jaw 54 may be located at a first end 60 of the body 52 and a second pedestal jaw 56 may be located at a second end 62 of the body 52, with each end defined by and located adjacent to the center opening 58, along the x-axis. Each of the pedestal jaws may be configured to receive a bearing adapter (not shown in FIG. 2), where each bearing adapter of the truck (e.g., two on each side frame) may rotatably receive an end of an axle supporting a wheel set. Thus, the wheel sets and the side frames of the truck may be mounted together by the bearing adapters. The bearing adapters permit relatively slight angular displacement of the axles.

As further shown in FIG. 3, the yaw separator 100 partially extends through the first side frame 50. The yaw separator 100 generally includes the first steering arm 200, the second steering arm 300, and the arm connector assembly 400. The first steering arm 200 and the second steering arm 300 are mirror images of each other, however, it should be appreciated that they do not need to be mirror images in accordance with the present disclosure. The steering arms may be elongated rigid members extending parallel to the body 52 of the first side frame 50. The steering arms may be connected to one another via the arm connector assembly 400 (e.g., the arm connector assembly 400 may be located in between the first steering arm 200 and the second steering arm 300). The arm connector assembly 400 may generally be comprised of a spring assembly as further illustrated and described with respect to FIGS. 8 and 9.

The position and connection points of the yaw separator 100 within the truck, as further described below, may allow the rotation of one bearing adapter to be transmitted by horizontally (e.g., along the x-axis) pivoting members (e.g., the first steering arm 200, the second steering arm 300) of the yaw separator 100 to the opposite bearing adapter. Thus, the mechanism of the yaw separator 100 will move or deflect compliantly to allow bearing adapters to move relative to one another as necessitated by track conditions, even into the otherwise undesirable in-phase bearing adapter configuration if/when appropriate. As the bearing adapter movement is translated along the yaw separator 100, undesirable in-phase conditions may be discouraged and, thus, will not be allowed to predominate in such a way that the truck behavior may become unstable (e.g., hunting, warping).

As the first steering arm 200 and the second steering arm 300 are connected via a spring assembly (e.g., an assembly of vertical leaf-type springs), the relatively small translations of the bearing adapters along the yaw separator 100 may not be subjected to relative sliding, thereby eliminating wear during use. Thus, the mechanism of the yaw separator 100 may elastically comply (e.g., undergo elastic movement) with the maximum range of movement available to the bearing adapter within the side frame pedestal jaw of a typical truck configuration, where the components of the yaw separator 100 may be below the fatigue/endurance limit of their respective materials even at the maximum range of bearing adapter movement. Elastic movement may be herein defined as movement occurring as energy is absorbed/dissipated through the slight bending and flexing of the subject components, without the components being moveable relative to one another per se.

Figure 4:
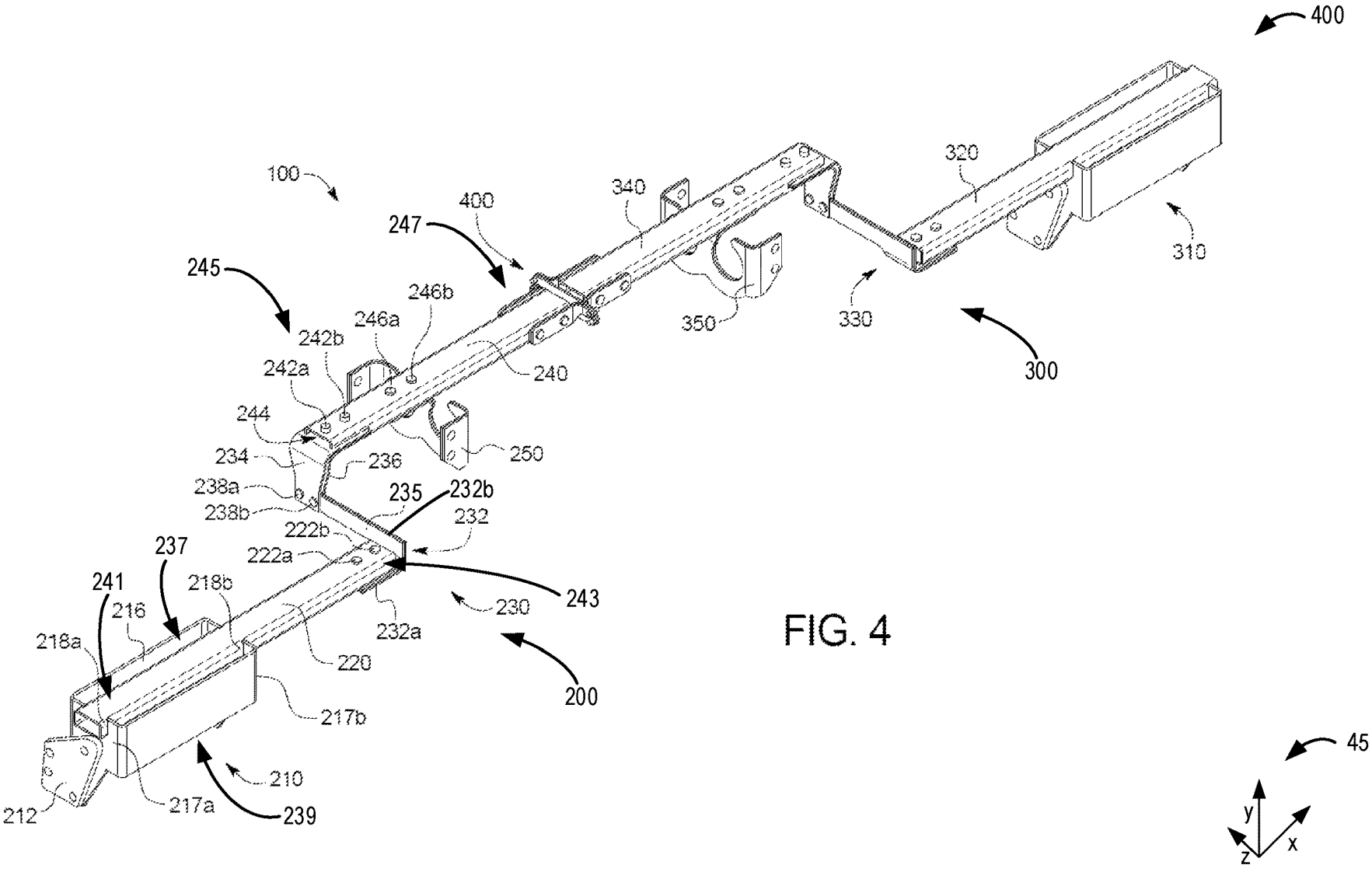
FIG. 4 is an enlarged side perspective view of the yaw separator of FIG. 2.
Figure 5:
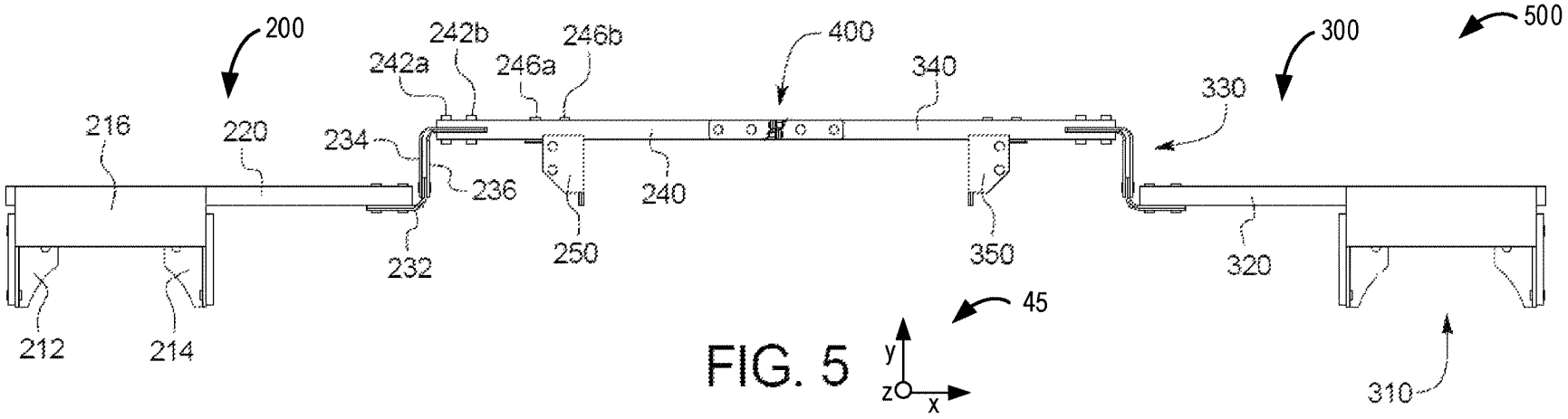
FIG. 5 is an enlarged side view of the yaw separator of FIG. 2.
Figure 6:
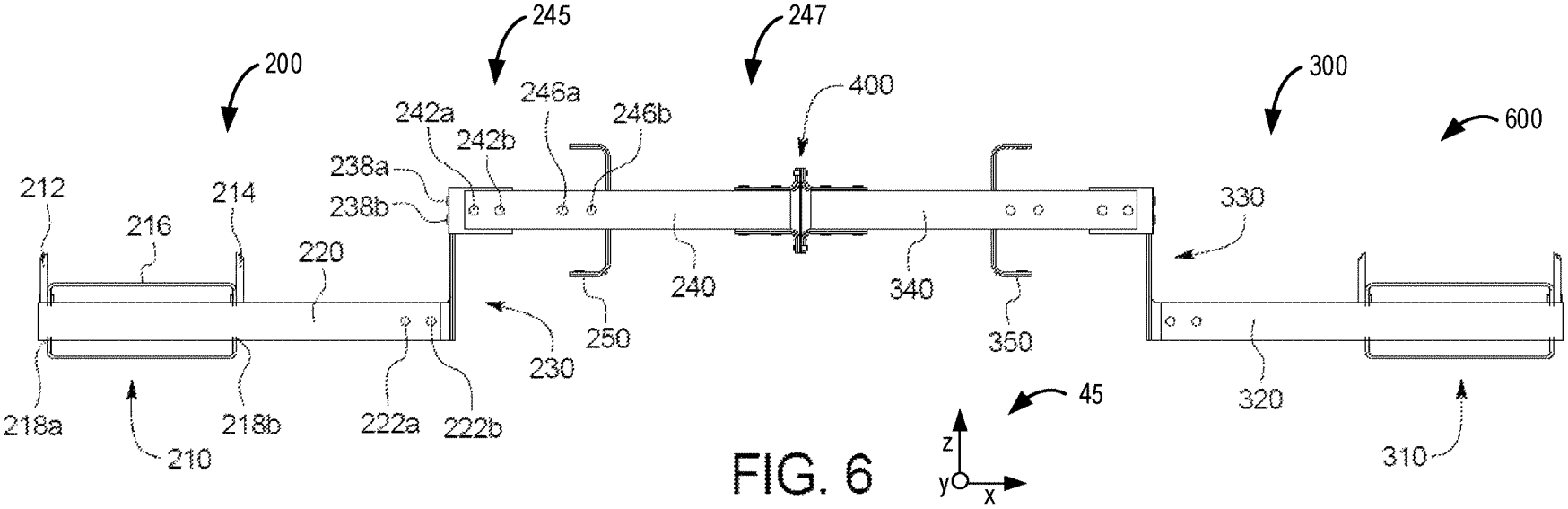
FIG. 6 is an enlarged top view of the yaw separator of FIG. 2.

Turning now to FIGS. 4-6, which show an enlarged side perspective view 400, a side view 500, and a top view 600, respectively, of the yaw separator 100, the first steering arm 200 of the yaw separator 100 may include a roller bearing adapter assembly connector 210, an exterior force transfer member 220, a transfer member connector assembly 230, an interior force transfer member 240, and a pivot bracket 250. The roller bearing adapter assembly connector 210 may include a first bearing coupler 212, a second bearing coupler 214, and a bearing coupler connector 216. The first bearing coupler 212 may include a curved bottom having engagement members configured to match a curvature of a bearing adapter assembly of the wheel set (not shown). Similarly, the second bearing coupler 214 may include a curved bottom having engagement members configured to mirror the first bearing coupler 212, and to also match the curvature of the bearing adapter assembly of the wheel set. The curvature of the first bearing coupler 212 and second bearing coupler 214 may enable the axle of the wheel set to rotate within the space between the first bearing coupler 212 and the second bearing coupler 214. The first bearing coupler 212 and second bearing coupler 214 may also enable forces generated by forward and/or backward "yaw" movement of the wheel set to be exerted onto or transferred to the yaw separator 100. As discussed in further detail below with respect to FIGS. 10-12, when a wheel experiences forward or backward yaw movement, the force may be transmitted to the yaw separator 100 via the roller bearing adapter assembly connector 210.

The bearing coupler connector 216 may be a generally rectangular tube shape having four upright faces (e.g., parallel with the y-axis), wherein a top 237 and a bottom 239 (e.g., defined and enclosed by the four upright faces) of the bearing coupler connector 216 are open. The first bearing coupler 212 may be affixed to a first face 217*a* of the bearing coupler connector 216 via a plurality of fasteners. Similarly, the second bearing coupler 214 may be affixed to a second face 217*b* of the bearing coupler connector 216 via a second plurality of fasteners, wherein the second face 217*b* is opposite the first face 217*a*. In some examples, the bearing couplers may be otherwise suitably affixed/fixedly connected to the bearing coupler connector 216 (e.g., via rivets, welding, a nut/bolt system). The first face 217*a* and the second face 217*b* may be perpendicular to the longitudinal axis of the rails. The first face 217*a* and the second face 217*b* may respectively define a first and a second aperture, 218*a* and 218*b*, that extends to the top 237 of the bearing coupler connector 216. The first and second apertures 218*a* and 218*b* may be rectangular in shape and receive the exterior force transfer member 220. The exterior force transfer member 220 may be an elongated rectangular hollow tube. In some examples, the exterior force transfer member 220 may be otherwise suitably shaped (e.g., an elongated square tube, a cylinder) and, thus, the first and second apertures 218*a* and 218*b* may be correspondingly shaped to receive the exterior force transfer member 220

The exterior force transfer member 220 may be positioned exterior to (e.g., outside of) the first side frame 50. In some examples, the exterior force transfer member 220 may be otherwise suitably positioned with respect to the first side frame 50 (e.g., within the interior of the first side frame 50). A first end 241 of the exterior force transfer member 220 may be fixedly connected to the roller bearing adapter assembly connector 210 via, for example, welds adjacent to the apertures 218*a* and 218*b*. In some examples, the exterior force transfer member 220 may be otherwise fixedly connected to the roller bearing adapter assembly connector 210 (e.g., the exterior force transfer member 220 may be fastened to the apertures 218*a* and 218*b*). The fixed connection of the exterior force transfer member 220 to the roller bearing adapter assembly connector 210 may enable forces exerted on the roller bearing assembly adapter connector 210 to be transmitted to the exterior force transfer member 220 and vice versa.

The exterior force transfer member 220 may include a plurality of spaced apart apertures, such as a first aperture 222*a* and a second aperture 222*b*. The plurality of spaced apart apertures may be located on a second end 243, opposite the first end 241, of the exterior force transfer member 220. The apertures 222*a* and 222*b* may align with corresponding apertures of the transfer member connector assembly 230, so that the exterior force transfer member 220 may be fixedly connected to the transfer member connector assembly 230 via the aligned apertures using a suitable mechanism (e.g., rivets, pins, fasteners). In this manner, via the fixed connection, forces exerted on the exterior force transfer member 220 may be transmitted to the transfer member connector assembly 230 and vice versa. In some embodiments, the second end 243 of the exterior force transfer member 220 may be welded to the member connector assembly 230 thereby eliminating the need for corresponding apertures within the exterior force transfer member 220 and the transfer member connector assembly 230. In some examples, the exterior force transfer member 220 and the transfer member connector assembly 230 may not be two separate components (e.g., the exterior force transfer member 220 and the transfer member connector assembly 230 may be die cast as a single component).

The transfer member connector assembly 230 may include a lateral extension plate 232, a first L-shaped connector plate 234, and a second L-shaped connector plate 236. The lateral extension plate 232 may include a first plate 232*a* and a second plate 232*b*. The first plate 232*a* may be connected to the exterior force transfer member 220 via one or more fasteners (e.g., via apertures 222*a* and 222*b*). The first plate 232*a* and the second plate 232*b* may be connected to each other at a generally 90° angle, such that the major surfaces of the first plate 232*a* and the second plate 232*b* are perpendicular to each other. The second plate 232*b* may extend perpendicular to a major axis (e.g., parallel to the x-axis) of the exterior force transfer member 220, as best illustrated in FIGS. 3 and 4.

The first L-shaped connector plate 234 may be connected to a first face 235 of the lateral extension plate 232 via two fasteners 238*a* and 238*b*. Further, the second L-shaped connector plate 236 may be connected to a second face (e.g., opposite the first face 235) of the lateral extension plate 232 via the two fasteners 238*a* and 238*b*. As such, the two fasteners 238*a* and 238*b* may extend through respective spaced apart apertures defined by the lateral extension plate 232. The first L-shaped connector plate 234 and the second L-shaped connector plater 236 may also be fixedly connected to the interior force transfer member 240, via two fasteners 242*a* and 242*b*. The fixed connection of the L-shaped connectors to the interior force transfer member 240 may enable forces acting on the transfer member connector assembly 230 to be transmitted to the interior force transfer member 240 and vice versa.

The interior force transfer member 240 may be similar to the exterior force transfer member 220 except in terms of positioning with respect to the first side frame 50. For example, the interior force transfer member 240 may include an elongated rectangular hollow tube. The interior force transfer member 240, however, may be positioned interior to the first side frame 50 (as shown in FIGS. 2 and 3). The interior force transfer member 240 may include a lateral (e.g., parallel to the z-axis) opening 244 at a first end 245 into which a section (e.g., the section perpendicular to the section fixedly connected to the transfer member connector assembly 230) of the first L-shaped connector plate 234 and a section (e.g., the section perpendicular to the section fixedly connected to the transfer member connector assembly 230) of the second L-shaped connector plate 236 may be inserted. Following insertion, fasteners 242*a* and 242*b* may connect the interior force transfer member 240 to the L-shaped connector plates such that the inserted sections of the L-shaped connector plates are disposed or sandwiched within the interior force transfer member 240 at the first end 245 via the lateral opening 244 (as best illustrated in FIGS. 3-5).

A second end 247 (e.g., located opposite the first end 245) of the interior force transfer member 240 may be fixedly connected to the arm connector assembly 400 via a plurality of fasteners. The fixed connection of the interior force transfer member 240 to the arm connector assembly 400 may enable forces acting on the interior force transfer member 240 to be transmitted to the arm connector assembly 400 and vice versa. Further, the interior force transfer member 240 may also be fixedly connected to the pivot bracket 250 via two fasteners 246*a* and 246*b*.

The pivot bracket 250 may be fixedly connected to a middle portion (e.g., located in between the first end 245 and the second end 247) of the interior force transfer member 240, via the fasteners 246*a* and 246*b*. The position of the fixed connection of the pivot bracket 250 with respect to the interior force transfer member 240 may enable the pivot bracket 250 to act as a pivot point about which the interior force transfer member 240 may see-saw in response to movement translations along the yaw separator 100. For example, as further described below, when a force (e.g., bearing adapter yaw) acts to pull the first end 245 the interior force transfer member 240 downward with respect to the y-axis, the interior force transfer member 240 may oscillate at the pivot bracket 250 such that the second end 247 of the interior force transfer member 240 may move in upward with respect to the y-axis. The pivot bracket 250 may be fixedly connected to an internal section of the side frame 50 via a plurality of fasteners.

As best illustrated in FIG. 4-6, the second steering arm 300 may be identical to the first steering arm 200, but flipped (e.g. along the x-axis). As such, second steering arm 300 may include a roller bearing adapter assembly connector 310, an exterior force transfer member 320, a transfer member connector assembly 330, an interior force transfer member 340, and a pivot bracket 350. Thus, the arrangement and fixed connections between the roller bearing adapter assembly connector 310, exterior force transfer member

320, transfer member connector assembly 330, interior force transfer member 340, pivot bracket 350, and arm connector assembly 400 may be as previously described with respect to the first steering arm 200. In some examples, the second steering arm 300 and the first steering arm 200 may not be identical.

Figure 7:
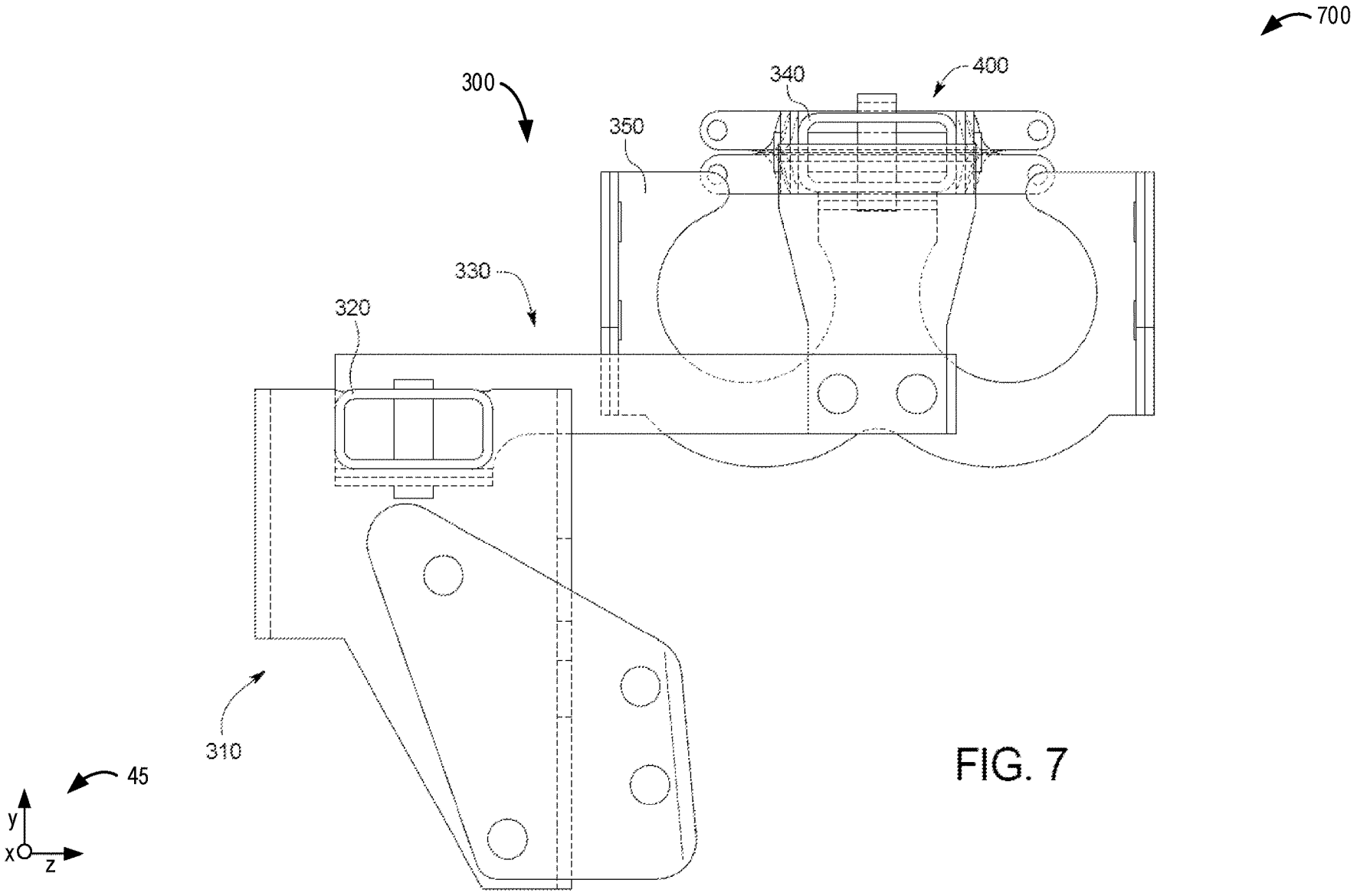
FIG. 7 is an enlarged end view of the yaw separator of FIG. 2.

FIG. 7 shows an enlarged end view 700 (e.g., along the x-axis) of the second steering arm 300 which may be identical to an enlarged end view of the first steering arm 200. As previously described with respect to the first steering arm 200, the roller bearing adapter assembly connector 310 of the second steering arm 300 may be fixedly connected to the exterior force transfer member 320. Additionally, the exterior force transfer member 320 may be fixedly connected to the transfer member connector assembly 330 which may be fixedly connected to the interior force transfer member 340. The interior force transfer member 340 may further be connected to a pivot bracket 350 and the arm connector assembly 400 of the yaw separator 100. The first steering arm 200 and the second steering arm 300 may be coupled to one another via the fixed connection of the interior force transfer members (e.g., interior force transfer member 240, interior force transfer member 340) to the arm connector assembly 400 as further shown in FIGS. 8 and 9.

FIGS. 8 and 9 show an enlarged top perspective view 800 and bottom perspective view 900, respectively, of the arm connector assembly 400 fixedly connected to the interior force transfer members of the yaw separator 100. As previously mentioned, the arm connector assembly 400 may include a spring set thus be comprised of a first spring assembly 410, a second spring assembly 430, and a plurality of fasteners 418*a*, 418*b*, 438*a*, and 438*b*. The first spring assembly 410 may include two sets of angle brackets and a lateral bracket connection plate 416 fixedly connected to each angle bracket set. The first set of angle brackets may be comprised of a first angle bracket 412*a* and a second angle 412*b*, where the second set may be comprised of a third angle bracket 414*a* and a fourth angle bracket 414*b*.

The lateral bracket connection plate 416 may extend laterally (e.g., parallel to the z-axis) with respect to a long axis (e.g., parallel to the x-axis) of the yaw separator 100, between interior force transfer member 240 and interior force transfer member 340. A first end 415 of the lateral bracket connection plate 416 may be connected to a first end 417 of the first set of angle brackets (e.g., first angle bracket 412*a*, second angle 412*b*) via a fastener 420*a*. Similarly, a second end 419 of the lateral bracket connection plate 416 may be connected to a first end 421 of the second set of angle brackets (e.g., third angle bracket 414*a*, fourth angle bracket 414*b*) via a fastener 420*b*. The sets of angled brackets may be fixedly connected to the lateral bracket connection plate 416 where the first set of angle brackets extends perpendicularly away (e.g., parallel to the x-axis) from a first face of the lateral bracket connection plate 416 and the second set of angle brackets extends perpendicularly away from a second face (e.g., opposite the first face) of the lateral bracket connection plate 416 (e.g., the sets of angle brackets may extend away from the lateral bracket connection plate 416 in opposite directions along the x-axis).

Further, a second end 425 (e.g., the end not connected to the lateral bracket connection plate 416) of the first set of angle brackets may be fixedly connected to a first upright side 423 (e.g., parallel to the y-axis) of the second end 247 of the interior force transfer member 240 via fasteners 418*a* and 418*b*. The first set of angle brackets may be connected to the interior force transfer member 240 and the lateral bracket connection plate 416 where the first angle bracket 412*a* is disposed/sandwiched between the second angle bracket 412*b* and the interior force transfer member 240 as well as the lateral bracket connection plate 416 (e.g., the first angle bracket 412*a* may be nested with the second angle bracket 412*b* so that, after connection with the first set of angle brackets, only the first angle bracket 412*a* is in face-sharing contact with the interior force transfer member 240 and the lateral bracket connection plate 416). Similarly, a second end 427 (e.g., the end not connected to the lateral bracket connection plate 416) of the second set of angle brackets may be fixedly connected to a first upright side (e.g., parallel to the y-axis) of a second end 429 of the interior force transfer member 340 via fasteners. The second set of angle brackets may be connected to the interior force transfer member 240 and the lateral bracket connection plate 416 where the third angle bracket 414*a* is disposed/sandwiched between the fourth angle bracket 414*b* and the interior force transfer member 240 as well as the lateral bracket connection plate 416.

The connected combination of the first angle bracket set and the second angle bracket set with the lateral extension plate 416 as well as the interior force transfer members may cause the spring assembly 410 to have an equilibrium position wherein each of the interior force transfer members are coaxial about the long axis (e.g., parallel to the x-axis). When a lateral yaw force is imparted onto either interior force transfer member 240 or interior force transfer member 340 thereby breaking the coaxial alignment, the force may be absorbed in part by the spring assembly 410, as illustrated in FIG. 11 and further described below. When a lateral yaw force is imparted onto both interior force transfer members in the same direction (e.g., forward or backward), the force may be transmitted through the spring assembly 410 such that absorption is minimized, as illustrated in FIG. 12 and further described below.

The second spring assembly 430 may be identical to the first spring assembly 410 but may have an inverted orientation with respect to spring assembly 410. The second spring assembly 430 may include two sets of angle brackets and a lateral bracket connection plate 436 fixedly connected to each angle bracket set. The first set of angle brackets may be comprised of a first angle bracket 432*a* and a second angle bracket 432*b*, where the second set may be comprised of a third angle bracket 434*a* and a fourth angle bracket 434*b*. The lateral bracket connection plate 436 may extend laterally (e.g., parallel to the z-axis) with respect to a long axis (e.g., parallel to the x-axis) of the yaw separator 100, between interior force transfer member 240 and interior force transfer member 340. A first end 435 of the lateral bracket connection plate 436 may be connected to a first end 439 of the first set of angle brackets (e.g., first angle bracket 432*a*, second angle 432*b*) via a fastener 440*a*. Similarly, a second end 437 of the lateral bracket connection plate 416 may be connected to a first end 441 of the second set of angle brackets (e.g., third angle bracket 434*a*, fourth angle bracket 434*b*) via a fastener 440*b*. The sets of angled brackets may be fixedly connected to the lateral bracket connection plate 436 where the first set of angle brackets extends perpendicularly away (e.g., parallel to the x-axis) from a first face of the lateral bracket connection plate 436 and the second set of angle brackets extends perpendicularly away from a second face (e.g., opposite the first face) of the lateral bracket connection plate 436 (e.g., the sets of angle brackets may extend away from the lateral bracket connection plate 436 in opposite directions along the x-axis).

Further, a second end 433 (e.g., the end not connected to the lateral bracket connection plate 436) of the first set of angle brackets may be fixedly connected to a first upright side 431 (e.g., parallel to the y-axis) of the second end 429 of the interior force transfer member 340 via fasteners 438*a* and 438*b*. The first set of angle brackets may be connected to the interior force transfer member 340 and the lateral bracket connection plate 436 where the first angle bracket 412*a* is disposed/sandwiched between the second angle bracket 412*b* and the interior force transfer member 240 as well as the lateral bracket connection plate 416 (e.g., the first angle bracket 432*a* may be nested with the second angle bracket 432*b* so that, after connection with the first set of angle brackets, only the first angle bracket 432*a* is in face-sharing contact with the interior force transfer member 340 and the lateral bracket connection plate 436). Similarly, a second end 443 (e.g., the end not connected to the lateral bracket connection plate 416) of the second set of angle brackets may be fixedly connected to a first upright side (e.g., parallel to the y-axis) of a second end 247 of the interior force transfer member 240 via fasteners. The second set of angle brackets may be connected to the interior force transfer member 240 and the lateral bracket connection plate 436 where the third angle bracket 434*a* is disposed/sandwiched between the fourth angle bracket 434*b* and the interior force transfer member 240 as well as the lateral bracket connection plate 436.

The connected combination of the first angle bracket set and the second angle bracket set with the lateral extension plate 436 as well as the interior force transfer members may cause the spring assembly 430 to have an equilibrium position wherein each of the interior force transfer members are coaxial about the long axis (e.g., parallel to the x-axis). When a lateral yaw force is imparted onto either interior force transfer member 240 or interior force transfer member 340 thereby breaking the coaxial alignment, the force may be absorbed in part by the spring assembly 430, as illustrated in FIG. 11 and further described below. When a lateral yaw force is imparted onto both interior force transfer members in the same direction (e.g., forward or backward), the force may be transmitted through the spring assembly 430 such that absorption is minimized, as illustrated in FIG. 12 and further described below.

FIGS. 10-12 illustrate how forces acting on one or more of the described components of a yaw separator, according to the embodiments described herein, may be fully or partially transferred to one or more other components. Further, one or more components may be configured to flex, bend, or otherwise absorb energy imparted by movement of the components. The force transfer and/or energy absorption imparted by the yaw separator component movement may result in favored or preferred orientations of the bearing adapters, wheel sets, and wheels. For brevity, these forces are discussed below with relation to the respective wheels. A set of directional axes 1050 are provided indicating movement with respect to the wheels in the illustrated examples, indicating forward (F), backward (B), inward (I), and outward (O) directions.

FIG. 10 illustrates a first scenario 1000 in which two horizontal (e.g., parallel to the z-axis) wheel axes 1010*a* and 1010*b* are parallel to each other, and perpendicular to the forward (F) direction (e.g., parallel to the x-axis, perpendicular to straight rails on which the train moves) as well as a first wheel 1020*a* and a second wheel 1020*b*, where the wheels are vertically (e.g. parallel to the y-axis) aligned to straight rails on which the train moves. In this first scenario 1000, no or minimal forces are transferred to the components of a yaw separator 1100 by the wheels 1020*a* and 1020*b*. As such, the yaw separator 1100 may be at an equilibrium position where it exerts no or minimal force onto the wheels 1020*a* and 1020*b*.

Alternatively, FIG. 11 illustrates a second scenario 2000 where out-of-phase yaw movement between a first wheel 2020*a* and a second wheel 2020*b* via a yaw separator 2100 of a truck is favored. The first wheel 2020*a* and the second wheel 2020*b* are similarly arranged to the wheelset of FIG. 10 (e.g., the wheels are vertically aligned to straight rails on which the train moves). When the first wheel 2020*a* experiences a forward or backward yaw movement, a proportional force is transmitted through the yaw separator 2100 to the second wheel 2020*b* on the same side of the truck, pushing the second wheel 2020*b* in the opposite direction. The transfer of forces through the yaw separator 2100, in part, both encourages out-of-phase yaw movement and discourages undesirable in-phase yaw movement of the wheels.

As previously described, the yaw separator 2100 may include an arm connector assembly 2400 that connects a first steering arm 2110 and a second steering arm 2120. The first steering arm 2110 may include a first interior force transfer member 2240 connected to the arm connector assembly 2400, a first pivot bracket 2250, and a first transfer member connector assembly 2230. The first transfer member connector assembly 2230 may be further connected to a first exterior force transfer member 2220 and a first roller bearing adapter assembly connector 2210. Similarly, the second steering arm 2120 may include a second interior force transfer member 2340 connected to the arm connector assembly 2400, a second pivot bracket 2350, and a second transfer member connector assembly 2330. The second transfer member connector assembly 2330 may be further connected to a second exterior force transfer member 2320 and a second roller bearing adapter assembly connector 2310.

To illustrate the forces acting on the components of the yaw separator 2100, various different scenarios are described below. In the second scenario 2000, a rotational force A1 may be imparted onto the first wheel 2020*a*. The rotational force A1 is in the forward (F) direction about a vertical wheel set axis 2012*a*. The rotational force A1 may be due to rail imperfections, movement of the rail vehicle onto a curve, friction in various elements, or for some other reason. The rotational force A1 may cause a yaw movement of the first wheel 2020*a* in the forward (F) direction with respect to a vertical wheel set axis 2012*a*, such that the horizontal wheel axis 2010*a* rotates counterclockwise (e.g., as indicated by arrow 2001) as shown in FIG. 11. Rotation of the wheel axis 2010*a* may cause the first roller bearing adapter assembly connector 2210 to experience a force A2 causing rotational movement in substantially the forward (F) direction with respect to the vertical wheel set axis 2012*a*.

The forward movement of the first roller bearing adapter assembly connector 2210 may be transferred to the first exterior force transfer member 2220, causing the first exterior force transfer member 2220 to experience a rotational force A3 at a second end 2212 (e.g., the end opposite to where the first roller bearing adapter assembly connector 2210 is connected to the first exterior force transfer member 2220) in a substantially forward (F) and inward (I) direction about the vertical wheel set axis 2012*a*. The rotational movement of the first exterior force transfer member 2220 may then be transferred to the first transfer member connector assembly 2230, causing the first transfer member connector assembly 2230 to experience a rotational force A4 in a substantially inward (I) direction about a first pivot bracket axis 2014*a*. Movement of the first transfer member connector assembly 2230 may then be transferred to a first end 2214 (e.g., the end opposite to an end connected to the arm connector assembly 2400) of the first interior force transfer member 2240, causing the first end 2214 to rotate in a substantially inward (I) direction about the first pivot bracket axis 2014*a*. The first interior force transfer member 2240 may then pivot about the first pivot bracket axis 2014*a*, thereby causing a second end 2216 (e.g., opposite to the first end 2214) of the first interior force transfer member 2240 to experience rotational force A5 in a substantially outward (O) direction about the first pivot bracket axis 2014*a*. The outward movement of the second end 2216 of the first interior force transfer member 2240 may cause the arm connector assembly 400 to absorb the force A5.

In response, a first end 2218 (e.g., the end connected to the arm connector assembly 2400) of the second interior force transfer member 2340 may experience the force A5 in a substantially outward (O) direction about a second pivot bracket axis 2014*b*. The second interior force transfer member 2340 may pivot about the second pivot bracket axis 2014*b*, thereby causing a second end 2222 (e.g., opposite to the first end 2218) of the second interior force transfer member 2340 to experience a rotational force A6 in a substantially inward (I) direction about the second pivot bracket axis 2014*b*. Movement of the second end 2222 of the second interior force transfer member 2340 may be transferred to the second transfer member connector assembly 2330, causing the second transfer member connector assembly 2330 to experience a rotational force A7 in a substantially inward and backward (B) direction about a vertical wheel set axis 2012*b*. The rotational movement of the second transfer member connector assembly 2330 may be transferred to the second exterior force transfer member 2320, causing the exterior force transfer member 2320 to experience a force A8 in a substantially backward (B) direction about the vertical wheel set axis 2012*b*. The backward movement of the second exterior force transfer member 2320 may then be transferred to the second roller bearing adapter assembly connector 2310. The movement of the second roller bearing adapter assembly connector 2310 may then be transferred to the second wheel 2020*b*, causing a force A9 to act on the second wheel 2020*b*. In this manner, forward yaw movement of the first wheel 2020*a* may be transmitted through the yaw separator 2100 to cause backward yaw movement of the second wheel 2020*b*.

Similarly, in a third scenario, a rotational force may be imparted onto the second wheel 2020*b* in the backward (B) direction where the backward yaw movement may be transmitted through the yaw separator 2100 to cause forward yaw movement of the first wheel 2020*a*. Thus, the arrangement of the yaw separator 2100 encourages out of phase yaw movement transfer from one wheel to the other, wherein forward movement of one wheel produces backward forces acting on another wheel located on the same side of the truck. The forces in the third scenario are similar or identical to those in the second scenario 2000, however the order in which they are transferred from one component of the yaw separator 2100 to the next is reversed. For example, the force A9 may be imparted on the second wheel 2020*b*, which causes the force A8 to be imparted on the second roller bearing adapter assembly connector 2310. This, in turn, may impart the force A7 on the second transfer member connector assembly 2330, which may impart the force A6 on the second interior force transfer member 2340. In turn, the second interior force transfer member 2340 may pivot about the second pivot bracket axis 2014*b*, thereby imparting the force A5 on the first end 2218 of the second interior force transfer member 2340 connected to the arm connector assembly 2400. The force A5 may then be absorbed in part and/or transmitted in part via the arm connector assembly 2400 to the first interior force transfer member 2240, which may pivot about the first pivot bracket axis 2014*a*. This, in turn, may impart the force A4 on the first transfer member connector assembly 2230, which then imparts the force A3 on the first exterior force transfer member 2220. This, in turn, may impart the force A2 on the first roller bearing adapter assembly connector 2210, which then imparts the force A1 in the forward direction on the first wheel 2020*a*.

In a fourth scenario, a force may act on the first wheel 2020*a* in the backward (B) direction, opposite the force A1. The fourth scenario may be identical to the second scenario, but with the direction of the forces and movement of the yaw separator 2100 components in the opposite direction. As such, backward yaw movement of the first wheel 2020*a* may result in a corresponding forward yaw movement of the second wheel 2020*b*. Similarly, in a fifth scenario, a force may act on the second wheel 2020*b* in the forward direction, opposite the force A9. The fifth scenario may be identical to the third scenario, but with the direction of the forces and movement of the yaw separator 2100 components in the opposite direction. As such, forward yaw movement of the second wheel 2020*b* may result in a corresponding backward yaw movement of the first wheel 2020*a*.

As illustrated in FIG. 12, in a sixth scenario 3000, a rotational force C1 may imparted onto a first wheel 3020*a* in the forward (F) direction about a vertical wheel set axis 3012*a*. The force C1 causes a yaw movement of the first wheel 3020*a* in the forward direction with respect to the vertical wheel set axis 3012*a*, such that a horizontal wheel axis 3010*a* may rotate counterclockwise. Rotation of the wheel axis 3010*a* may cause a first roller bearing adapter assembly connector 3210 of a yaw separator 3100 to experience a force C2 causing rotational movement in substantially the forward direction with respect to the vertical wheel set axis 3012*a*.

As previously described, the yaw separator 3100 may include an arm connector assembly 3400 that connects a first steering arm 3110 and a second steering arm 3120. The first steering arm 3110 may include a first interior force transfer member 3240 connected to the arm connector assembly 3400, a first pivot bracket 3250, and a first transfer member connector assembly 3230. The first transfer member connector assembly 3230 may be further connected to a first exterior force transfer member 3220 and the first roller bearing adapter assembly connector 3210. Similarly, the second steering arm 3120 may include a second interior force transfer member 3340 connected to the arm connector assembly 3400, a second pivot bracket 3350, and a second transfer member connector assembly 3330. The second transfer member connector assembly 3330 may be further connected to a second exterior force transfer member 3320 and a second roller bearing adapter assembly connector 3310.

The forward movement of the roller bearing adapter assembly connector 3210 may be transferred to the first exterior force transfer member 3220, causing the first exterior force transfer member 3220 to experience a rotational force C3 at a second end 3212 (e.g., the end opposite to where the first roller bearing adapter assembly connector 3210 is connected to the first exterior force transfer member 3220) in a substantially forward (F) and inward (I) direction (e.g., away from the yaw separator 2100) about the vertical wheel set axis 3012*a*. The rotational movement of the first exterior force transfer member 3220 may be transferred to the first transfer member connector assembly 3230, causing the first transfer member connector assembly 3230 to experience a rotational force C4 in a substantially inward (I) direction about a first pivot bracket axis 3014*a*. Movement of the first transfer member connector assembly 3230 may be transferred to a first end 3214 (e.g., opposite to an end connected to the arm connector assembly 3400) of the first interior force transfer member 3240, causing the first end 3214 to rotate in a substantially inward (I) direction about the first pivot bracket axis 3014*a*. In turn, the first interior force transfer member 3240 may pivot about the first pivot bracket axis 3014*a*, thereby causing a second end 3216 (e.g., opposite the first end 3214) of the first interior force transfer member 3240 to experience a rotational force C5 in a substantially outward (O) direction about the first pivot bracket axis 3014*a*.

Concurrently, a rotational force D1 may be imparted onto the second wheel 3020*b* in the forward direction about a vertical wheel set axis 3012*b*. The force D1 may cause yaw movement of a second wheel 3020*b* in the forward direction with respect to a vertical wheel set axis 3012*b*, such that a horizontal wheel axis 3010*b* rotates counterclockwise. Counterclockwise rotation of the horizontal wheel axis 3010*b* may cause the second roller bearing adapter assembly connector 3310 to experience a force D2 that causes rotational movement in substantially the forward direction with respect to the vertical wheel set axis 3012*b*. In turn, the forward movement of the second roller bearing adapter assembly connector 3310 may then be transferred to the second exterior force transfer member 3320, causing the second exterior force transfer member 3320 to experience a rotational force D3 at a second end 3224 (e.g., the end opposite to where the second roller bearing adapter assembly connector 3310 is connected to the second exterior force transfer member 3320) in a substantially forward (F) and outward (O) direction about the vertical wheel set axis 3012*b*.

The rotational movement of the second exterior force transfer member 3320 may then be transferred to the second transfer member connector assembly 3330, causing the second transfer member connector assembly 3330 to experience a rotational force D4 in a substantially outward (O) direction about a second pivot bracket axis 3014*b*. In turn, movement of the second transfer member connector assembly 3330 may then be transferred to a first end 3222 (e.g., the end opposite to an end connected to the arm connector assembly 3400) of the second interior force transfer member 3340, causing the first end 3222 to rotate in a substantially outward (O) direction about the second pivot bracket axis 3014*b*. In turn, the second interior force transfer member 3340 may pivot about the second pivot bracket axis 3014*b*, thereby causing a second end 3218 (e.g., opposite the first end 3222) of the second interior force transfer member 3340 to experience a rotational force C5 in a substantially inward (I) direction about the second pivot bracket axis 3014*b*. In turn, the forces C5 and D5 may be imparted on the arm connector assembly 3400 in opposite directions. The opposing forces C5 and D5 may act in a shearing motion, which is dynamically discouraged by the arrangement of spring assemblies (see at least FIGS. 8 and 9) within the arm connector assembly 3400. Thus, in-phase yaw movement of the first wheel 3020*a* and the second wheel 3020*b* in the same direction may be discouraged.

In a seventh scenario, a rotational force may be imparted onto the first wheel 3020*a* in the backward (B) direction about the vertical wheel set axis 3012*a* and a rotational force imparted onto the second wheel 3020*b* in the backward (B) direction about the vertical wheel set axis 3012*b*. The seventh scenario may be identical to the sixth scenario, but with the direction of the forces and movement of the components in the opposite direction. As a result, forces may be imparted on the arm connector assembly 3400 in opposite directions from each other opposite to that shown in the sixth scenario 3000 (e.g., a first force may be imparted opposite to C5/in the inward (I) direction and a second force may be imparted opposite to D5/in the outward (O) direction). The opposing forces may act in a shearing motion, which is dynamically discouraged by the arrangement of the spring assemblies within the arm connector assembly 3400. Thus, in-phase yaw movement of the first wheel 3020*a* and the second wheel 3020*b* in the same direction may be discouraged.

Various embodiments of the yaw separator 100 have been described and illustrated herein. It should be appreciated that one or more components, features, or parts of the yaw separator 100 may have a different shape, size, orientation, or other characteristic than those specifically explained or illustrated in accordance with the present disclosure. For example, the exterior force transfer member 220, interior force transfer member 240, exterior force transfer member 320, and interior force transfer member 340 have been described as being rectangular hollow tubes. However, in some embodiments these members may be circular, square, triangular, or any other suitable shape. Further, the one or more fasteners described herein may be pins, bolts, rivets, welds, or any other suitable mechanisms for attaching one component to another, including both rotatably attaching (e.g., such that rotation or movement is allowed), and non-rotatably attaching (e.g., such that no rotation or movement is allowed). Further, each component of the yaw separator 100 described herein may be made from a suitably strong material. For instance, the interior and exterior transfer members may be comprised of steel. One or more other components or part comprising the yaw separator may be steel as well. Each part/component may have a specific thickness or grade as well to provide the functions of each part/component as described herein. In embodiments, the yaw separator does not need any lubrication. Further, according to another aspect, the yaw separator does not involve sliding friction or relative rotation as a mechanism of function. Further, according to another aspect, it may be the case that the yaw separator does not include any moving parts.

In various embodiments and in various circumstances, the yaw separator may also act to provide other biasing forces to the side frames and/or may co-act with one or more other components of the truck to provide other biasing forces to the side frames. These other biasing effects may be considered as secondary potential biasing effects. Further, according to another aspect, the yaw separator may require adding relatively little additional material or weight to the truck. In some embodiments, the yaw separator described herein may be light weight and retrofit into a truck. In some embodiments, the yaw separator may be housed entirely within the hollow volume of a side frame of a truck and, thus, may be protected from the service environment. In some embodiments, the yaw separator may be partially housed within the hollow volume of a side frame in a manner different than shown and described for the example yaw separator 100. In some embodiments, the yaw separator may not be housed within a side frame of a truck and may be externally attached to the side frame. It will be understood that modifications and variations may be effected without departing from the scope of the novel concepts of the present invention, and it is understood that this application is to be limited only by the scope of the claims.

Thus, embodiments of the yaw separator of the present disclosure may be employed in a vehicle truck, where the yaw separator may react to yaw displacement at bearing adapters within each side frame of the truck thereby altering the dynamics that lead to truck hunting while retaining the properties and features of the truck. The mechanism of the yaw separator may move or deflect compliantly to allow the bearing adapters to move relative to one another as necessitated by track conditions. In this way, undesirable in-phase conditions may be discouraged and not allowed to predominate in such a way that the truck behavior may become unstable.

Although embodiments are described herein in regards to rail vehicles, other embodiments may relate to vehicles more generally, e.g., a yaw separator as disclosed herein might be usable on an on-road trailer bogie.

FIGS. 1-12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

Directions and orientations herein refer to the normal orientation of a rail vehicle in use. Thus, unless the context clearly requires otherwise, the "longitudinal" axis or direction is substantially parallel to straight tracks or rails and in the direction of movement of the rail vehicle on the track or rails in either direction. The "transverse" or "lateral" axis or direction is in a horizontal direction substantially perpendicular to the longitudinal axis and the straight tracks or rails. The "leading" side of the truck means the first side of a truck of a rail vehicle to encounter a turn, and the "trailing" side is opposite of the leading side. A truck is considered "square" when its wheels are aligned on parallel rails and the axles are parallel to each other and perpendicular to the side frames.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A vehicle truck comprising:

a side frame; and a yaw separator connected to the side frame including:

a first steering arm;

a second steering arm; and an arm connector assembly comprising at least one bracket connecting a first end of the first steering arm to a bracket connection plate and at least one bracket connecting a first end of the second steering arm to the bracket connection plate, the yaw separator configured to alter yaw movement of the truck that leads to truck hunting via elastic movement of the first steering arm, the second steering arm, and the arm connector assembly.

2. The truck of claim 1, wherein the yaw separator partially extends in a lateral direction to the side frame through a hollow space within the side frame.

3. The truck of claim 1, wherein a second end of the first steering arm is connected to a first roller bearing adapter assembly connector and a second end of the second steering arm is connected to a second roller bearing adapter assembly connector and the second roller bearing adapter assembly connector each include a first bearing coupler and a second bearing coupler.

4. The truck of claim 1, wherein the first roller bearing adapter assembly connector comprising a first bearing coupler, and the first bearing coupler includes a curved bottom having engagement members configured to match a curvature of a bearing adapter of a wheel set of the truck.

5. The truck of claim 4, wherein the second bearing coupler is a mirror image of the first bearing coupler and includes a curved bottom having engagement members configured to match the curvature of the bearing adapter of the wheel set of the truck.

6. The truck of claim 1, wherein a second end of the first steering arm is connected a first roller bearing adapter assembly connector and the first roller bearing adapter assembly connector is engaged with the bearing adapter of the wheel set via the first bearing coupler and the second bearing coupler.

7. The truck of claim 6, wherein the second roller bearing adapter assembly connector is engaged with another bearing adapter of the wheel set via another first bearing coupler and another second bearing coupler.

8. The truck of claim 1, wherein yaw movement of a wheel of the wheelset is transferred to onto the yaw separator via a first roller bearing adapter assembly or a second roller bearing adapter assembly.

9. The truck of claim 8, wherein the yaw movement is transferred from the first roller bearing adapter assembly connector to the first end of the first steering arm, and where the yaw movement is subsequently transferred to the second steering arm via the arm connector assembly.

10. The truck of claim 9, wherein the yaw movement is transferred from the second roller bearing adapter assembly connector to the first end of the second steering arm where the movement is subsequently transferred to the first steering arm via the arm connector assembly.

11. The truck of claim 1, wherein the yaw separator is retrofit into the side frame.

12. The truck of claim 1, wherein the yaw separator is connected to an external surface of the side frame.

13. A yaw separator comprising:

a first steering arm including:

a first interior force transfer member connected to a first exterior force transfer member via a first transfer member connector assembly, the first exterior force transfer member also connected to a first roller bearing adapter assembly connector;

a second steering arm including:

a second interior force transfer member connected to a second exterior force transfer member via a second transfer member connector assembly, the second exterior force transfer member also connected to a second roller bearing adapter assembly connector; and an arm connector assembly connected to the first interior force transfer member of the first steering arm and the second interior force transfer member of the second steering arm, the arm connector assembly includes a spring assembly, and the spring assembly comprising two sets of angle brackets and a lateral bracket connection plate.

14. The yaw separator of claim 13, wherein the first interior force transfer member and the second interior force transfer member are each connected to a pivot bracket.

15. The yaw separator of claim 13, wherein the first transfer member connector assembly comprises an extension plate extending in lateral direction relative to the yaw separator.

16. A yaw separator device for a vehicle truck comprising:

a first steering arm configured to be connected to an end of a first wheel set of the truck;

a second steering arm configured to be connected to an end of a second wheel set of the truck; and an arm connector assembly comprising a connection plate pivotably connected to the first steering arm and pivotably connected to the second steering arm, the arm connector assembly including one or more spring assemblies, the first steering arm, the second steering arm, and the arm connector assembly configured to be connected to a side frame of the truck, the first wheel set and the second wheel set, such that when a force acts on the end of the first wheel set in a first direction, the arm connector assembly transmits a corresponding force to the end of the second wheel set in a second direction opposite the first direction.

17. The yaw separator device of claim 16, wherein the arm connector assembly is configured to align the first steering arm and the second steering arm along a longitudinal axis of the side frame in an equilibrium position.

18. The yaw separator device of claim 16, wherein the one or more spring assemblies of the arm connector assembly are configured to enable movement of the arm connector assembly in a lateral direction responsive to movement of the end of the first wheel set in the first direction and movement of the end of the second wheel set in the second direction opposite the first direction.

19. The yaw separator device of claim 16, wherein the one or more spring assemblies of the arm connector assembly are configured to prevent movement of the arm connector assembly in a lateral direction responsive to movement of the end of the first wheel set in the first direction and movement of the end of the second wheel set in the first direction.

20. The yaw separator device of claim 16, wherein at least one bracket connects the first steering arm to the connection plate and at least one bracket connects the second steering arm to the connection plate.

* * * * *